US005890307A

United States Patent [19]

Chapelle

[11] Patent Number: 5,890,307

[45] Date of Patent: Apr. 6, 1999

[54] BRACKET FOR INDEX TAB AND A HANGING FILE FOLDER PROVIDED WITH SUCH BRACKET

[75] Inventor: Alain Chapelle, Lyons, France

[73] Assignee: L'Oblique, Villeurbanne, France

[21] Appl. No.: 842,401

[22] Filed: Apr. 24, 1997

[30] Foreign Application Priority Data

Apr. 26, 1996 [FR] France ..... 96 05520

[51] Int. Cl.[6] ..... G09F 3/10

[52] U.S. Cl. ..... 40/641; 40/359; 248/200

[58] Field of Search ..... 248/200, 223.41, 248/225.11; 40/641, 340, 359, 360, 374; 283/36, 37, 41, 39

[56] References Cited

U.S. PATENT DOCUMENTS

| | | | |
|---|---|---|---|
| 1,329,569 | 2/1920 | Yaxley | 40/641 X |
| 2,151,359 | 3/1939 | Schmitz | 40/641 X |
| 2,248,355 | 7/1941 | Jones | 40/641 X |
| 2,357,070 | 8/1944 | Bates | 40/641 X |
| 2,480,686 | 8/1949 | Aigner | 40/641 X |
| 2,545,014 | 3/1951 | Andersen | 40/641 |
| 2,675,636 | 4/1954 | Schulz | 40/360 X |
| 3,062,217 | 11/1962 | Woodhouse, Jr. | 40/641 X |
| 3,164,917 | 1/1965 | Harper | 40/641 |
| 3,248,814 | 5/1966 | Zwolinski et al. | 40/641 |
| 3,626,619 | 12/1971 | Boedeker | 40/641 |
| 4,232,461 | 11/1980 | Crawford . | |

FOREIGN PATENT DOCUMENTS

| | | |
|---|---|---|
| 1349479 | 12/1962 | France . |
| 2254952 | 12/1973 | France . |

*Primary Examiner*—Ramon O. Ramirez
*Assistant Examiner*—Long Dinh Phan
*Attorney, Agent, or Firm*—Dowell & Dowell, P.C.

[57] ABSTRACT

A bracket for index tabs of hanging file folders comprising a transparent sleeve and an element secured to the file folder, characterized by the fact that the sleeve can be directionally positioned by pivoting around a more or less vertical axis. The bracket may be provided with a structure to immobilize the sleeve directionally positioned in relation to its pivot axis which may be provided with notches suitable for interacting with at least one stop pin on the element.

20 Claims, 10 Drawing Sheets

BRACKET FOR INDEX TAB AND A HANGING FILE FOLDER PROVIDED WITH SUCH BRACKET

BACKGROUND OF THE INVENTION

1. Field of the Invention

The present invention relates to a bracket for identification labels or index tabs of hanging file folders and to a hanging file folder provided with such a bracket.

2. History of the Related Art

When hanging file folders are placed inside a cabinet, such as a filing cabinet, or a closet, it is known to provide each of them with a label or index tab, that is held by a bracket generally made of a plastic material and connected at least to one of the principal sides of the hanging file folder, constituted by a sheet of cardboard. It is essential for the comfort of the user that these index tabs be easily legible. The ease of reading of an identification tab depends essentially on its width. Where a large number of thin files are hung on the rack of a cabinet or a closet, their transversal capacity is determined by the width of their respective tabs. As a matter of fact, the width of the tab determines the width of the bracket and, in the case where thin folders are used, the width of the bracket for the tab is wider than the hanging folder itself. Therefore, should the tab be too wide, not many file folders can be hung from a rack and an installation with an optimum density of file folders cannot be considered.

On the other hand, it is known that a filing cabinet or a closet containing hanging files can be accessed from a direction that is not perpendicular to its front face. This is particularly the case when the closet or the cabinet is installed in a corner of a room or if the user reaches for the hanging files from a determined position such as, for example, from a chair that does not exactly face the cabinet or close. In such a case, this individual's angle of vision of the hanging files does not correspond to the orthogonal direction for which the brackets of known construction are designed.

Now then, the transparent sleeves of the tab brackets are designed in such a manner that they produce, in a direction comprised in their plane of symmetry, a magnifying glass effect, allowing a better readability of the labels. The user who reaches at an angle for a hanging file does not have the advantage of this magnifying glass effect and can be bothered by the reflection of light on the external surface of the sleeves of the brackets.

SUMMARY OF THE INVENTION

The present invention solves all of these problems and its main object is to provide a bracket for index tabs that would allow the hanging of file folders on racks in a cabinet or closet with a maximum thickness or density since the readability of the tabs can be improved by increasing their width. Another aim of the present invention is that of providing a good readability of the index tabs of the hanging file folders, including the case when the user reaches at an angle for the hanging folders.

With this in mind, the invention relates to an index tab bracket for hanging file folders, comprising a transparent sleeve and an element bound to the file, characterized by the fact that this sleeve is adjustable by pivoting around an essentially vertical axis.

Thanks to the invention, the sleeve and the tab it contains can be positioned in a manner not perpendicular to the sides of the hanging file folder, so that the transversal squeezing of the bracket is reduced which makes it possible to hang a greater number of file folders on the rack. Furthermore, it is possible to adjust the sleeve, and therefore also the index tab, in the direction of the reader, which would facilitate its reading.

According to an advantageous aspect of the invention, the tab bracket comprises means to immobilize the sleeve in a position with respect to its pivot axis, so that the sleeve is kept in the position chosen by user. These means of immobilization can comprise a series of notches suitable for the interlocking of at least one stop; by way of example, the stops are arranged side by side essentially perpendicular to the pivot axis of the sleeve.

In accordance with one embodiment of the invention, the sleeve may be provided with at least one extension with the slots while the bracket is provided with at least one stop. Moreover, the bracket is designed in such a manner that it consists of two parts that are interconnected by a hinge that determines the pivot axis.

In accordance with an advantageous variant of the present invention, the sleeve may be provided with notches at one of its extremities while the bracket has at its extremity, in the proximity of the notches, a lug with a stop.

In accordance with another embodiment of the present invention, the sleeve is provided with at least one extension provided with a notch while the bracket for the tabs is provided with the notches. In this case, and in accordance with a particularly beneficial aspect of the invention, the notches may extend along the major portion of the height of the bracket.

Lastly, the invention also relates to a hanging file provided with a bracket.

BRIEF DESCRIPTION OF THE DRAWINGS

The invention will be better understood and its other advantages will be seen more clearly through the below description of five embodiments of an index tab bracket for hanging file folders in accordance with its principle, given only by way of example and making reference to the accompanying drawings wherein.

DESCRIPTION OF THE PREFERRED EMBODIMENTS

Figure 1:
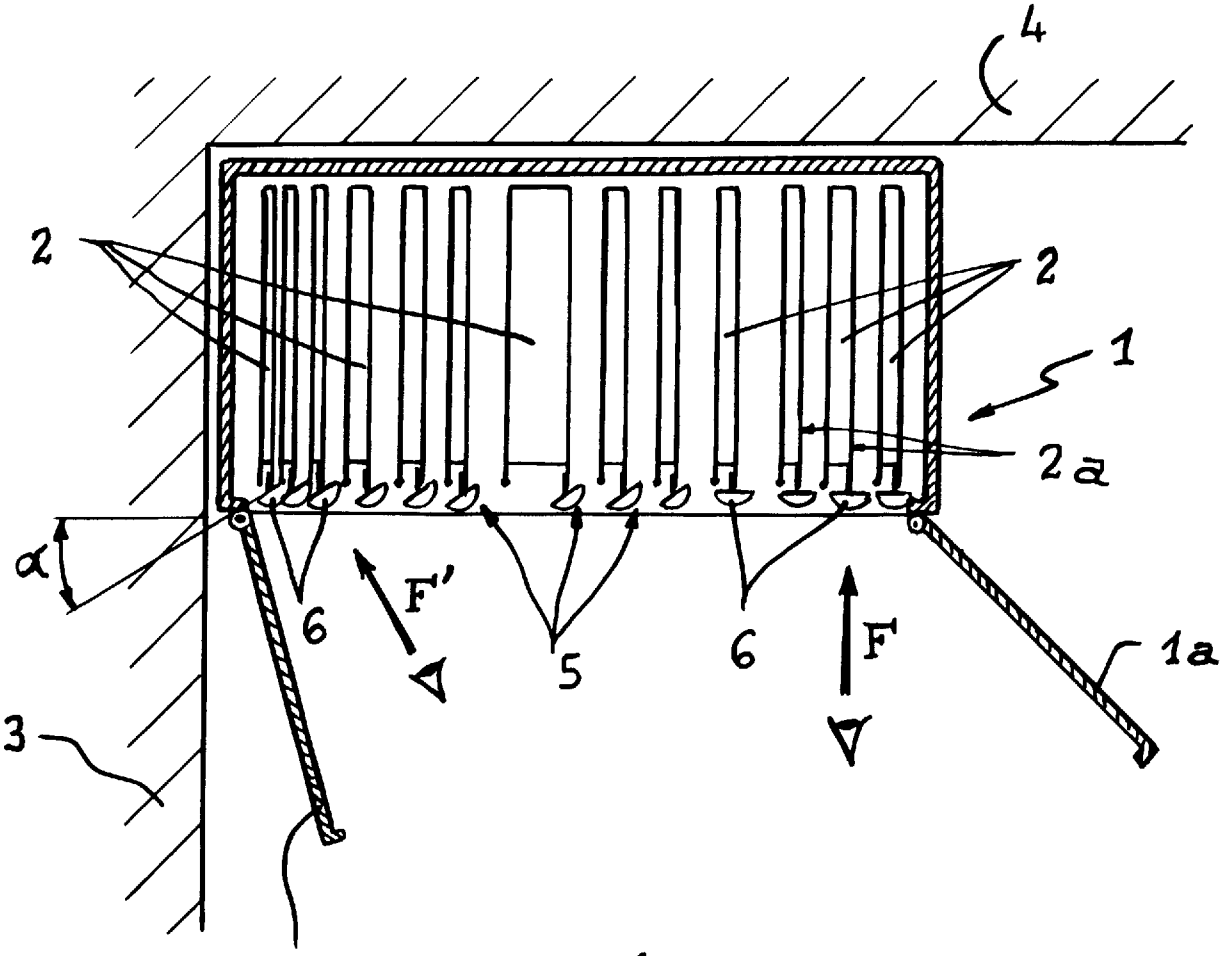
FIG. 1 is a schematic horizontal section of a storage closet with several hanging file folders.

In FIG. 1 is shown a cabinet 1 containing several hanging file folders 2, the cabinet placed in a corner of a room formed by two walls 3 and 4.

When the user reaches for the most distant files from the corner of the walls 3 and 4, he can do it in a direction F' that is essentially perpendicular to the bottom of the cabinet 1. In order to do this, the right door 1*a* of the cabinet may be opened more than 90°. However, if the user wishes to reach for the hanging file folders located on the side of the angle of the walls 3 and 4, he reaches them in a direction F' that is at an angle with respect to the bottom of the cabinet 1, particularly because of the space occupied by the second door 1*b* of the cabinet 1.

Each of the hanging file folders 2 is provided with a bracket 5 into which can be slipped an index tab 10 that details the references or the title of the documents contained in each hanging file folder 2.

In accordance with the present invention, the brackets 5 are adjustable by pivoting around an essentially vertical axis, so that the index tab brackets located at the left of the cabinet 1 can be turned in such a manner as to be essentially perpendicular to the direction F', which facilitates their reading by a user who looks art them from this direction.

Additionally, the position occupied by each bracket 5 in a parallel direction to the bottom of the cabinet 1 is lower than the width of each bracket 5 because it corresponds to the width of each bracket 5 multiplied by the cosine of the angle a of the direction of the bracket 5 with respect to a plane parallel to the bottom of the cabinet 1 passing through the turning or pivot axis of the brackets. This results in gaining considerable space because the file folders located in the part of the cabinet in which the brackets 5 are positioned at an angle may be arranged very close together, which includes the case when the tab bracket and the tab are wider than the width of each hanging file folder.

By way of example, it can be noted that the width of the usually used tabs for hanging file folders is 6.35 mm (¼ inch), which corresponds to the setting of 1.5 spacing of a typical typewriter. Each of these tabs is within a transparent sleeve 6 of which the outside dimensions determine the transversal capacity of the bracket 5. In the case of a tab whose width is 8.47 mm (⅓ inch) which corresponds to double spacing of a typical typewriter, when this tab is positioned at a 35° angle, its capacity on a parallel plane to the bottom of the cabinet 1 is equal to the outside dimension of the transparent sleeve multiplied by the cosine of 25°, that is to say 0.82, which, should the transparent sleeve not have a thickness greater than that of a 6.35 mm tab, results in a lesser transversal squeezing than with the subsequently used tab.

Thus, the invention affords not only a better readability of the index tabs of the hanging file folders but also a reduced squeezing of the hanging file folders on a plane parallel to the bottom of the cabinet in which they are kept.

By using the invention, it can even be envisaged to use tabs whose width is increased to 10.5 mm (5/12 inches) which corresponds to a 2.5 spacing on a typical typewriter. Such a tab could be used without increasing the transversal squeezing of the bracket inasmuch as its angle a of direction would be rather large, that is to say, that the cosine of this angle would be rather.

Figure 2:
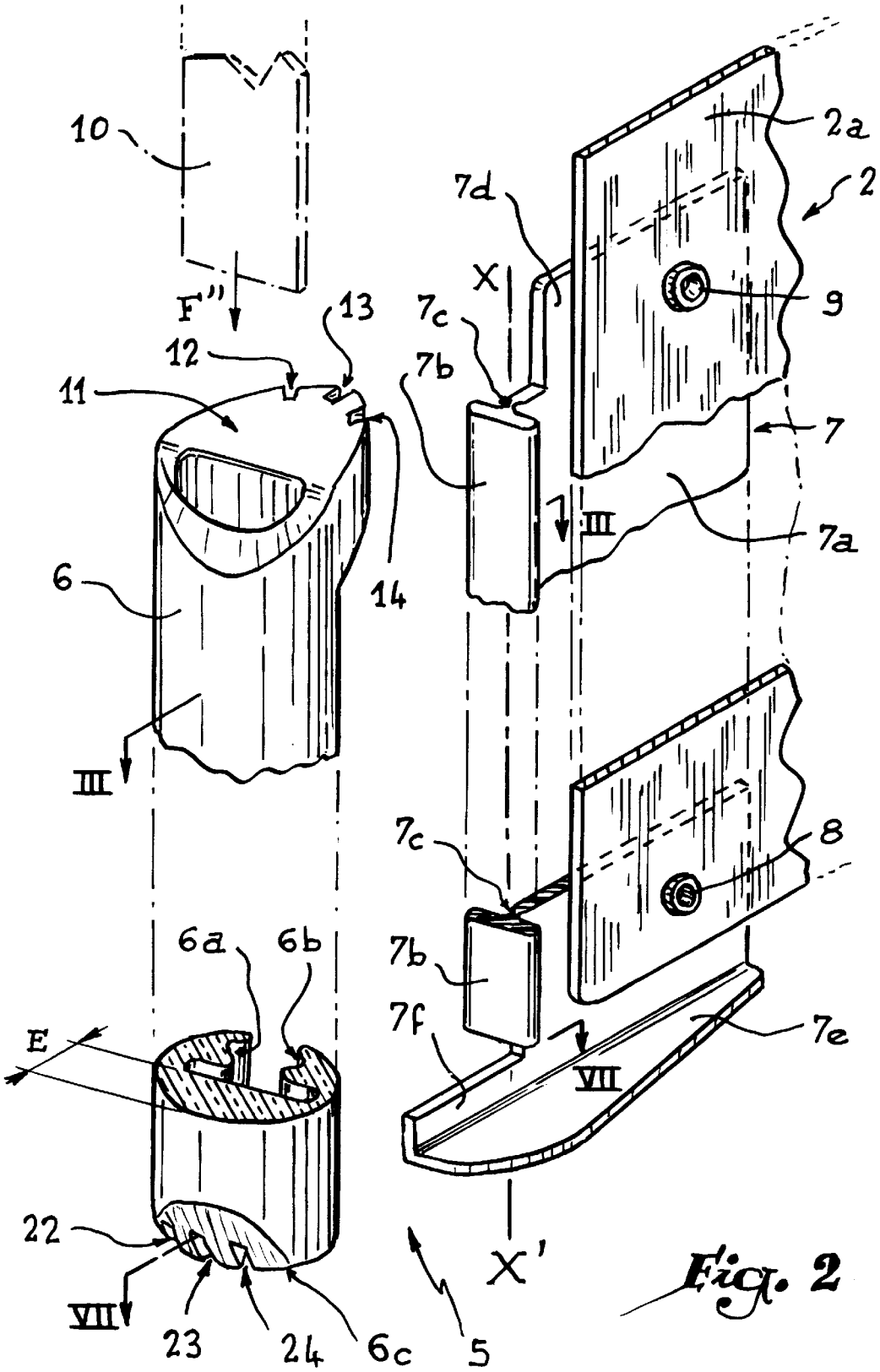
FIG. 2 is an exploded view in perspective with cutaway section of the central portion of an index tab bracket in accordance with a first embodiment of the invention.

The bracket illustrated in FIG. 1 is shown more detailed in FIG. 2. It essentially comprises a transparent sleeve 6 and an element 7 that is mounted on one of the large sides 2*a* of the hanging file folder by any suitable means, for example, by two rivets traversing the body 7*a* of the element 7. This element 7 is also provided with a tongue 7*b* secured essentially perpendicular to the body 7*a* and secured to it by strip 7*c* of a thinner material than that of the body 7*a* and forming a turning or pivot axis X–X' that is more or less vertical. The material of the element 7 is selected so that the strip 7*c* has a flexibility such that it allows the turning or pivoting of the tongue 7*b* about the axis X–X'. By way of example, poplypropylene is particularly suitable to this effect and the strip 7*c* may be obtained by crimping the body 7*a* made out of this material.

The lateral extremities of the tongue 7*b* are suitable to interact with two longitudinal grooves 6*a* and 6*b* of the transparent sleeve 6. The sleeve 6 is placed on the element 7 by having the tongue 7*b* slide within the grooves 6*a* and 6*b* until the lower extremity 6*c* of the sleeve 6 is more or less at the same level as the lower extremity of the tongue 7*b*. When the sleeve 6 is mounted on the tongue 7, the sleeve is subjected to the same turning movements about the axis X–X' as the tongue 7*b*. An index tab 10 is placed inside the sleeve 6 by inserting it in its upper portion in a direction F" and it can be read through the front face of the sleeve 6 whose thickness E creates a magnifying glass effect.

Figure 3:
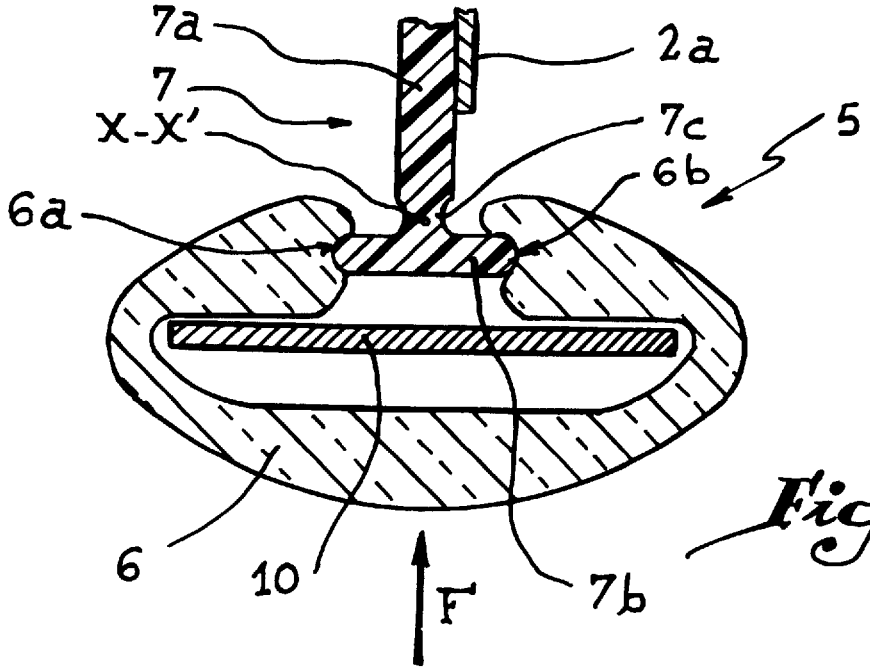
FIG. 3 is a sectional view of the bracket illustrated in FIG. 2 along the line III—III, after the placing of the tab, when the bracket is in such a position that the tab it holds is perpendicular to the large sides of the hanging folder on which it is mounted.
Figure 4:
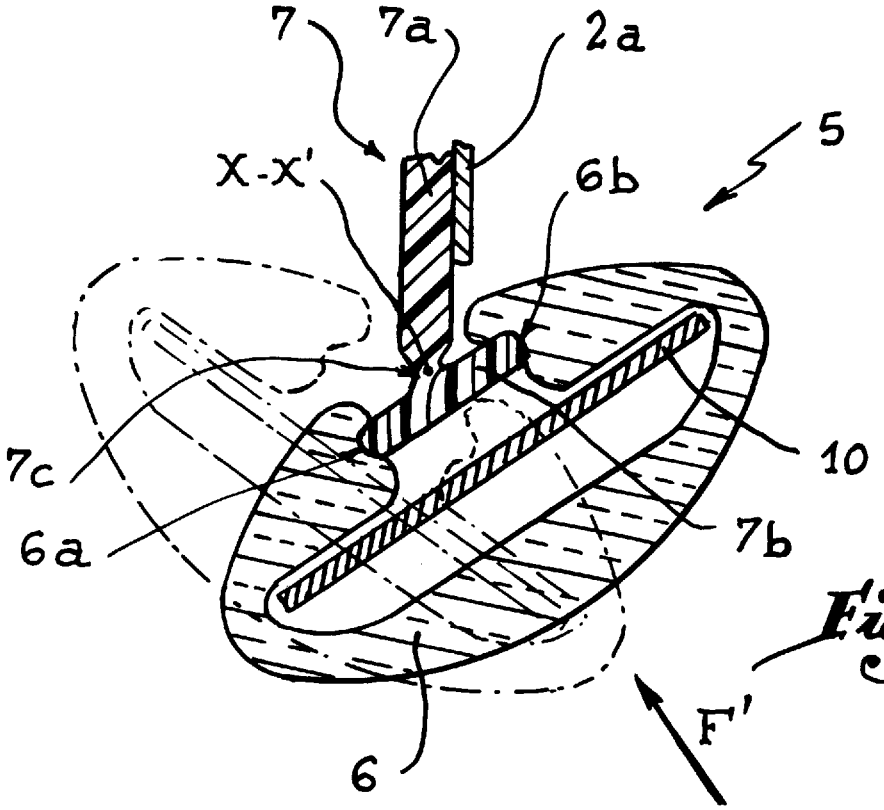
FIG. 4 is a sectional view analogous to that of FIG. 3, in which the bracket is positioned at an angle with respect to the large sides of the hanging folder.

As it appears more clearly by comparing FIGS. 3 and 4, the sleeve 6 and the tab 10 can be directionally positioned in such a manner that the tab is perpendicular to a regular observation direction F to the bottom of the cabinet 1 or to a direction F' at an angle with respect to this bottom by pivoting around the axis X–X'. Thus, for example, the hanging file folders located on the right side of the cabinet 1 of FIG. 1 may have a tab bracket positioned as shown in FIG. 3 while the hanging file folders located on the left side of the cabinet 1 may have a tab bracket in the position illustrated in FIG. 4. It must be understand that, according to the observation direction of the tab bracket, the sleeve may be turned in an opposite direction to attain the position represented by broken lines in FIG. 4.

Figure 5:
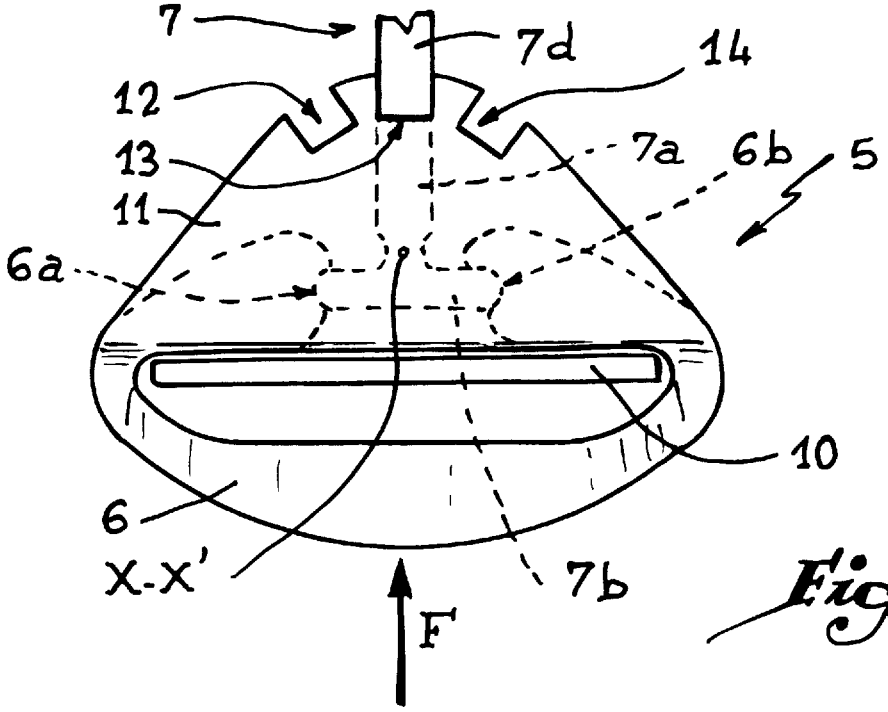
FIG. 5 is a top view of the bracket illustrated in FIG. 2 with the bracket in the position illustrated in FIG. 3.
Figure 6:
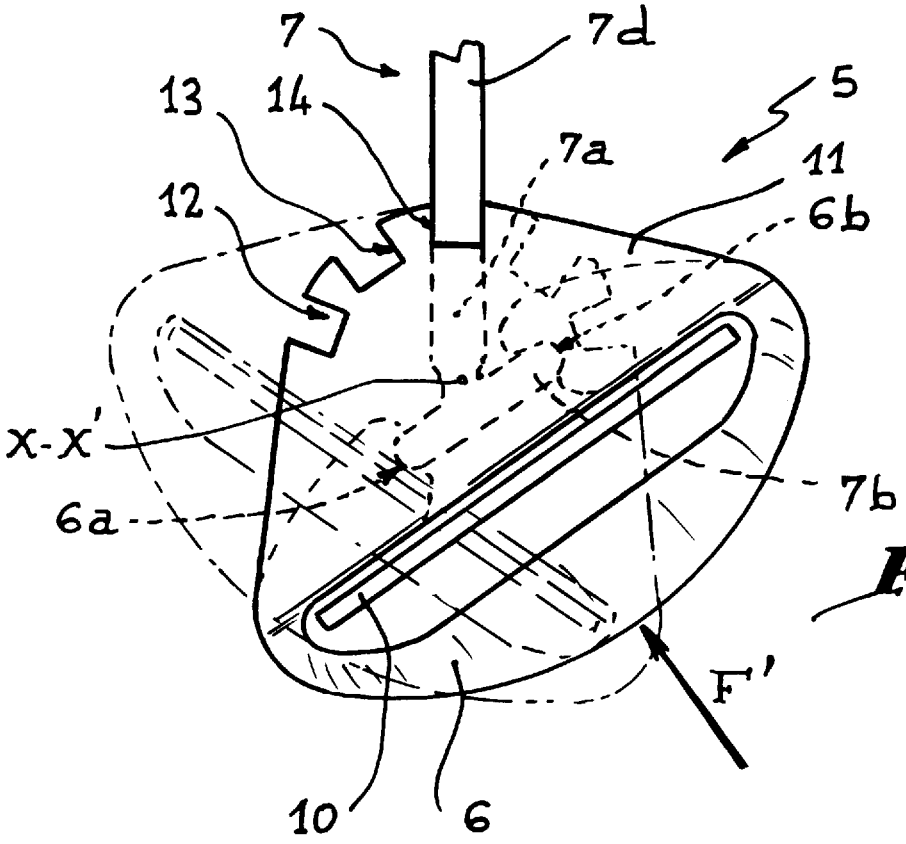
FIG. 6 is a view analogous to that of FIG. 5 with the bracket in the position illustrated in FIG. 4.

In accordance with a particularly advantageous aspect of the invention, the tab bracket comprises immobilizing means for the sleeve in a directional position with respect to its pivot axis. It is important that when the sleeve 6 is placed in the position illustrated in FIG. 4, it does not automatically return to the position shown in FIG. 3 by the effect of the elastic strip 7*c*. To attain this, the sleeve 6 is provided on its upper part with an extension 11 that has three notches 12, 13 and 14 arranged on a section of the extension 11 forming a circular arc. The body 7*a* is also provided with an extension forming a stop 7*d* suitable to engage into one of the notches 12 to 14. With special regard to FIGS. 5 and 6, it can be noted that the stop 7*d* is engaged in the central notch 13 when the tab is visible in accordance with direction F, that is to say, when the tab 10 must be more or less parallel to the bottom of the cabinet 1 in which is placed the hanging file folder. This position can be seen in FIG. 5. On the other hand, when the tab must be readable from the direction F', the stop 7*d* is engaged in one of the lateral notches, notch 14 in the example. As before, a symmetrical position shown in broken lines can be obtained by positioning the sleeve 6 in the opposite direction.

The passage from one position to another is obtained by exercising traction on the sleeve 6 so as to disengage the catch 7*d* from the notch 12, 13 or 14 in which it is engaged. This relative movement with respect to the stop 7*d* is possible because of the flexibility of the materials used for this element 7 and the sleeve 6.

Figure 7:
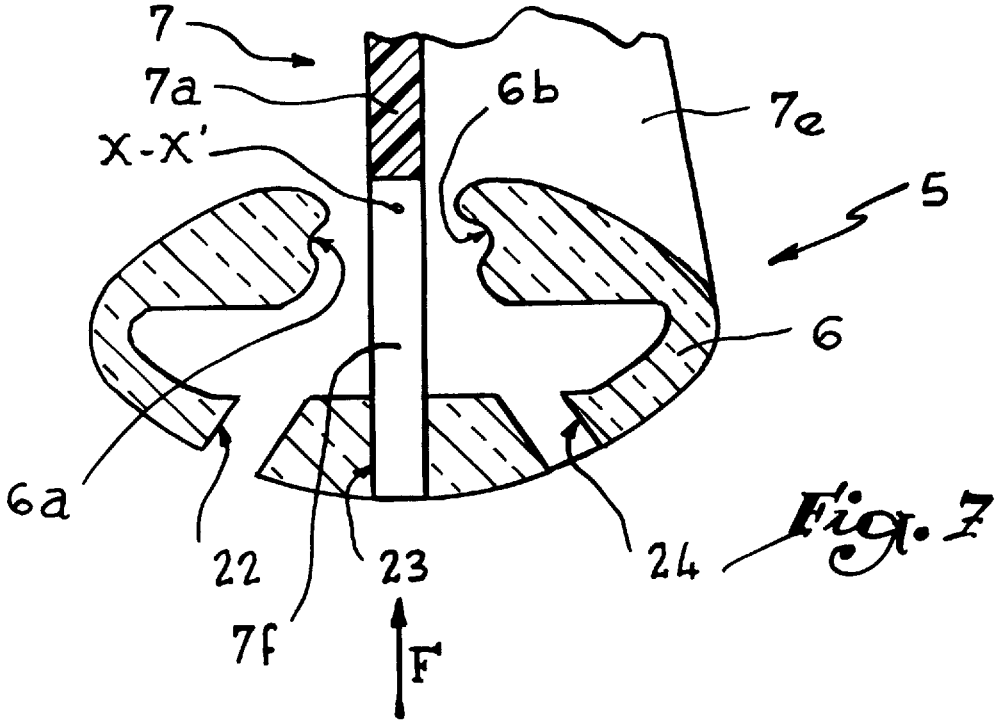
FIG. 7 is a sectional view of the bracket illustrated in FIG. 2, along the line VII—VII with the bracket in the position illustrated in FIG. 3.
Figure 8:
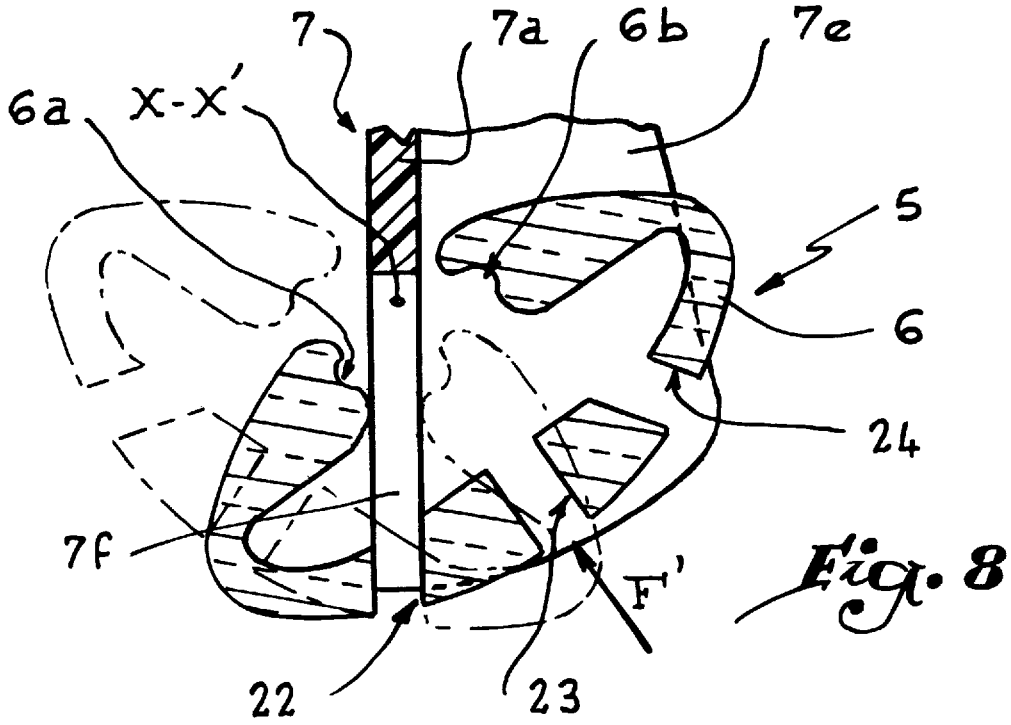
FIG. 8 is a view analogous to that of FIG. 7 with the bracket in the position illustrated in FIG. 4.

In accordance with another advantageous aspect of the present invention, the tab bracket of FIG. 1 is provided with second immobilizing means for the sleeve 6 in a directional position with respect to the axis X–X'. These other means are constituted by three notches 22, 23 and 24 arranged at, the lower extremity 6*c* of the sleeve 6, while at the lower extremity of element 7 is a lug 7*e* provided with a second stop 7*f*. When the sleeve 6 is placed in the tongue 7*b*, it is pushed by the user so that one of the notches 22, 23 or 24 encircle the stop 7*f*. When the stop 7*f* is positioned in one of the notches 22 to 24 arranged in a-circular arc, the sleeve 6 is immobilized in its relation to the axis X–X'. FIGS. 7 and 8 show the position of the stop 7*f* in notch 22 or notch 23, respectively, according to the direction of the tab bracket chosen by the user. Should the user wish to change the direction of the sleeve 6, he can disengage the stop 7*f* from the notch 22, 23 or 24 by slightly lifting the sleeve 6 and impart upon the sleeve 6 the desired movement prior to pushing downward the sleeve so that one of the notches houses the stop 7*d*. It must be noted that the inherent weight of the sleeve 6 is a stability factor for the assembly obtained by the interaction between the stop 7*f* and the notch 22, 23 or 24 in which it is engaged.

Figure 9:
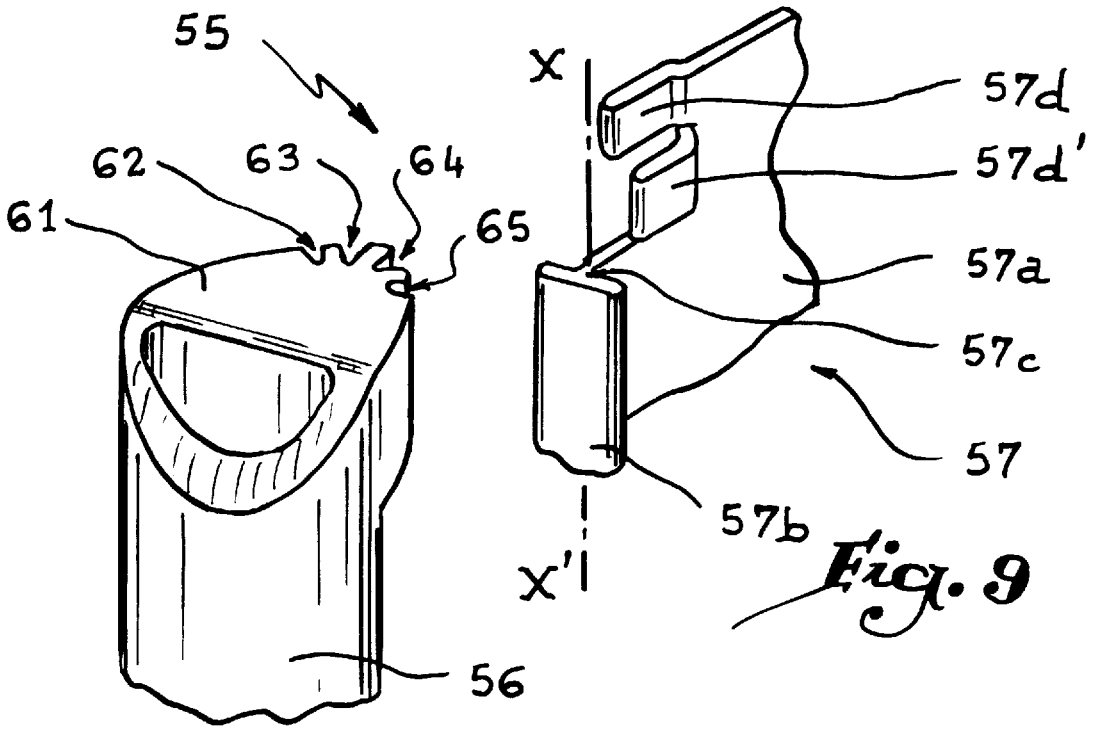
FIG. 9 is an exploded view in perspective of the upper part of an index tab bracket for hanging file folders in accordance with a second embodiment of the invention.
Figure 10:
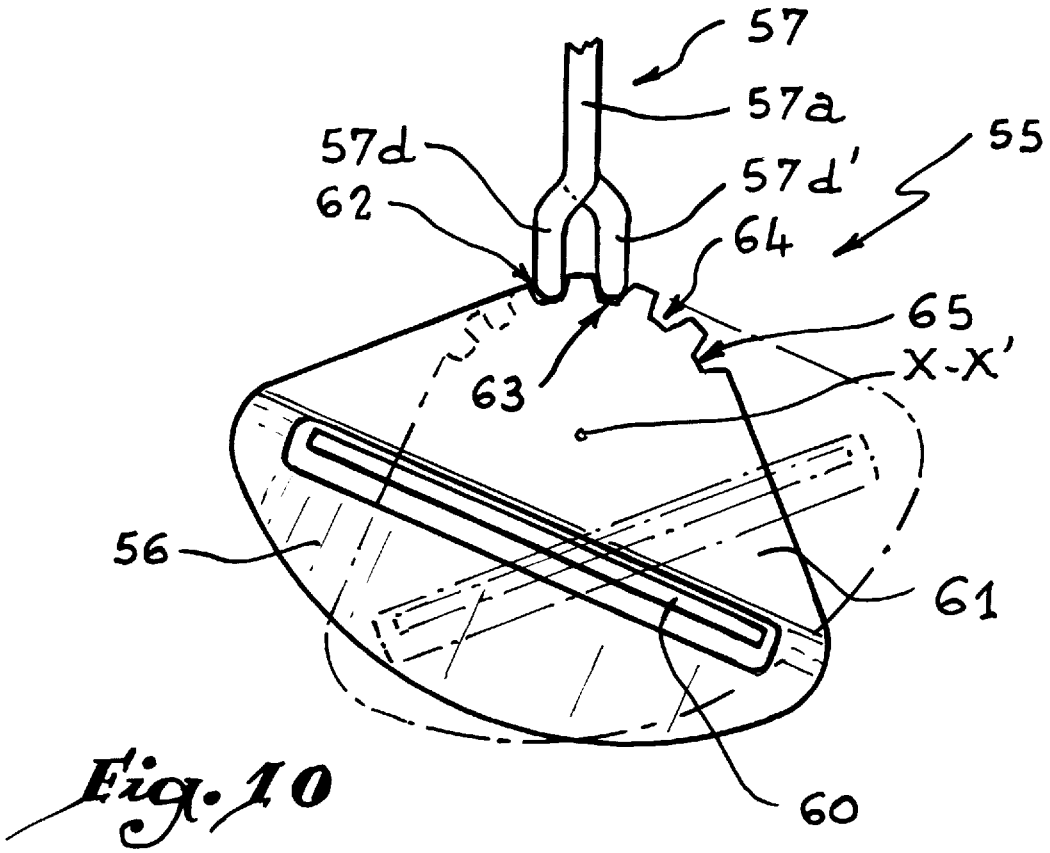
FIG. 10 is a top view of the device illustrated in FIG. 9 positioned at an angle with respect to the large sides of the hanging file folder on which it is mounted.

FIGS. 9 and 10 represent a second embodiment of the present invention in which the elements that are similar to those of the embodiment of FIGS. 1 to 8 are referenced by the same numbers increased by 50. The bracket 55 of this embodiment differs from the previous one in that its element 7 is provided on its top part with two stops 57*d* and 57*d*' set off with respect to the axis of symmetry of a body 57*a* of the element 57, so that each of them catches simultaneously into a notch of a series of four notches 62 to 65 arranged in a circular arc along the border of an extension 61 of a transparent sleeve 56. This embodiment presents the particular advantage that, due to the double immobilization resulting from the two stops 57*d* and 57*d*', the tab bracket of the invention is very tightly held in the position chosen by the user for the reading of a tab 60, by the rotation of the sleeve 56 and a tongue 57*b* around a pivot axis X–X', delimited by a strip 57*c* forming a hinge.

Figure 11:
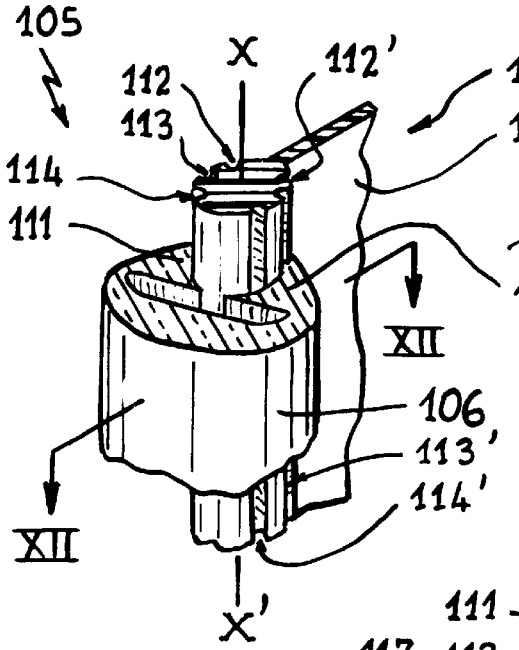
FIG. 11 is a partial view in perspective of an index tab bracket for hanging file folders in accordance with a third embodiment of the invention.

FIG. 11 presents a third embodiment of the present invention, in which the elements that are similar to those of the embodiment of FIGS. 1 to 8 are referenced by the same numbers increased by 100. The bracket 105 of this embodiment differs from the previous one essentially in that the directionally positioning of a sleeve 106, with inserted tab 110, is obtained because of the design of the element 107 of the bracket. As a matter of fact, the element 107 is provided with an extension 107*b* of cylindrical shape and provided with grooves or notches 112, 113, 114, 112', 113', and 114'. These grooves that are distributed in a circular arc formed by the surface of the section of the extension 107*b*, extend along the major portion of the height of the element 107, that is to say of the bracket 105. The transparent plastic sleeve 106 comprises two extensions 111 and 111' each of which is provided with a stop 117, 117', respectively. Each of these stops 117 or 117' is designed to enter into the grooves 112 to 114 and 112' to 114'. The stops 117 and 117' may extend along the major portion of the height of the sleeve 106 or be provided only on one section of it. Thus, the axis of symmetry of the extension 107*b* merges with the pivot axis X–X' of the sleeve 106.

In accordance with a not shown embodiment of the invention, several stops 117 and 117' can be distributed along the height of the extensions 111 and 111'.

Figure 12:
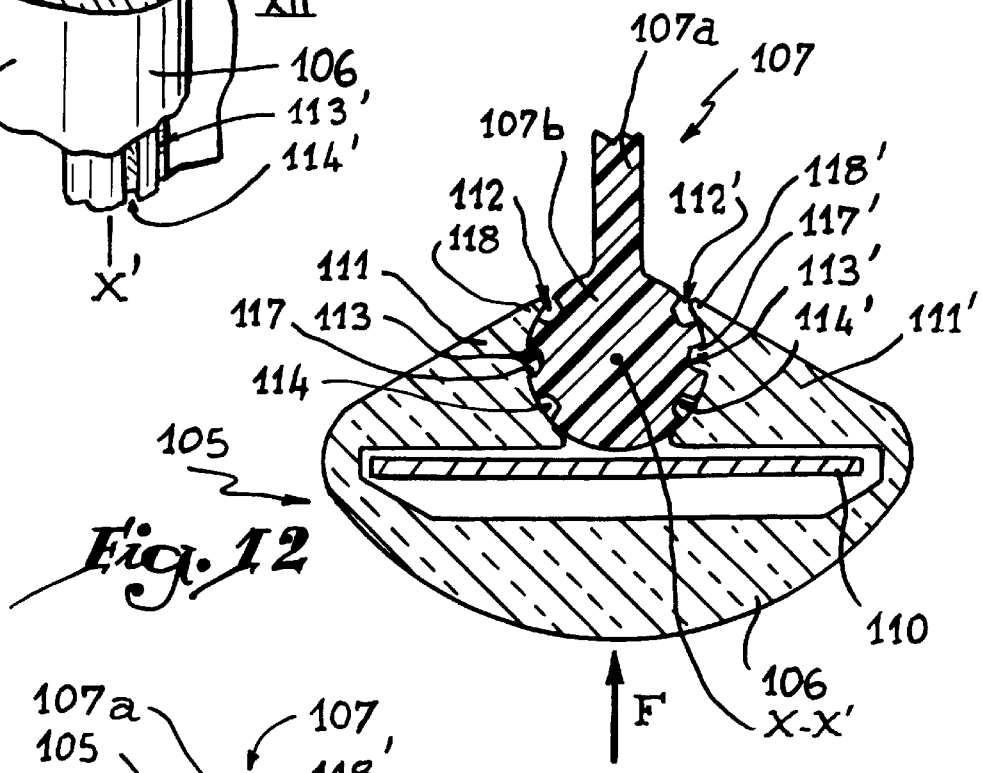
FIG. 12 is a sectional view in perspective of the device illustrated in FIG. 11 along the line XII—XII with the bracket in such a position that the tab it holds is perpendicular to the large sides of the hanging file folder on which it is mounted.

The functioning is as follows. When it is necessary to place the sleeve 106 over the element 107, it is driven by a vertical translatory motion in such a manner that the stops 117 and 117' penetrate into two diametrically opposed notches or grooves. When the user wishes to directionally position the sleeve 106 with respect to the axis X–X' passing through the center of the extension 107*b*, he exercises a torque with respect to this axis on the sleeve 106, whose extensions 111 and 111' bend because of the elastic properties of the material used for its manufacture. This allows the stops 117 and 117' to become disengaged from the grooves in which they were lodged. When the angular position corresponding to the interlocking of the stops 117 and 117' in a second set of grooves or notches is obtained, due to the elasticity effect of the extensions 111 and 111', the stops penetrate into the corresponding grooves. The operation according to the invention can thus be easily achieved from the position illustrated in FIG. 12 to one of the positions shown in full or broken lines in FIG. 13.

Figure 13:
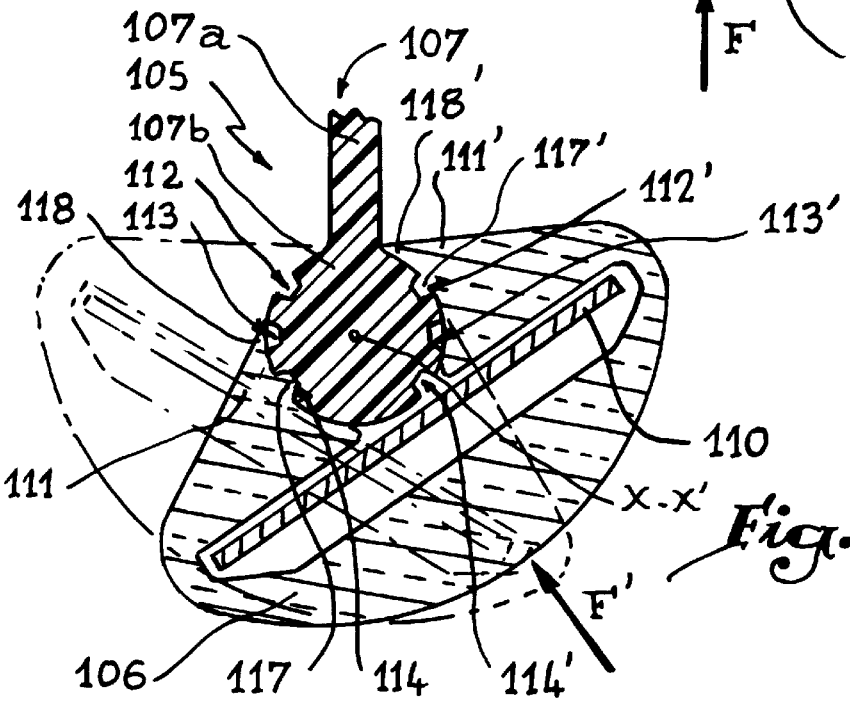
FIG. 13 is a view analogous to that of FIG. 12 with the bracket positioned at an angle with respect to the large sides of the hanging file folder.

With special regard to FIGS. 13, it can be noted that one extremity 118' of the extension 111' abuts against the body 107*a* of the element 107 when the sleeve 106 is positioned at an angle with respect to the large sides of the hanging file folder on which is mounted the bracket of the invention. This abutting of the extremity 118', that can be effected along the greatest portion of the height of the bracket 105, imparts a good mechanical stability to the device and prevents its deterioration should a user exert upon the sleeve 106 a torque that would tend to make it pass beyond the position shown in full lines in FIG. 13. It must be understood that the extremity 118 of the extension 111 does also constitute a thrust-block in the position shown in broken lines in FIG. 13.

Figure 14:
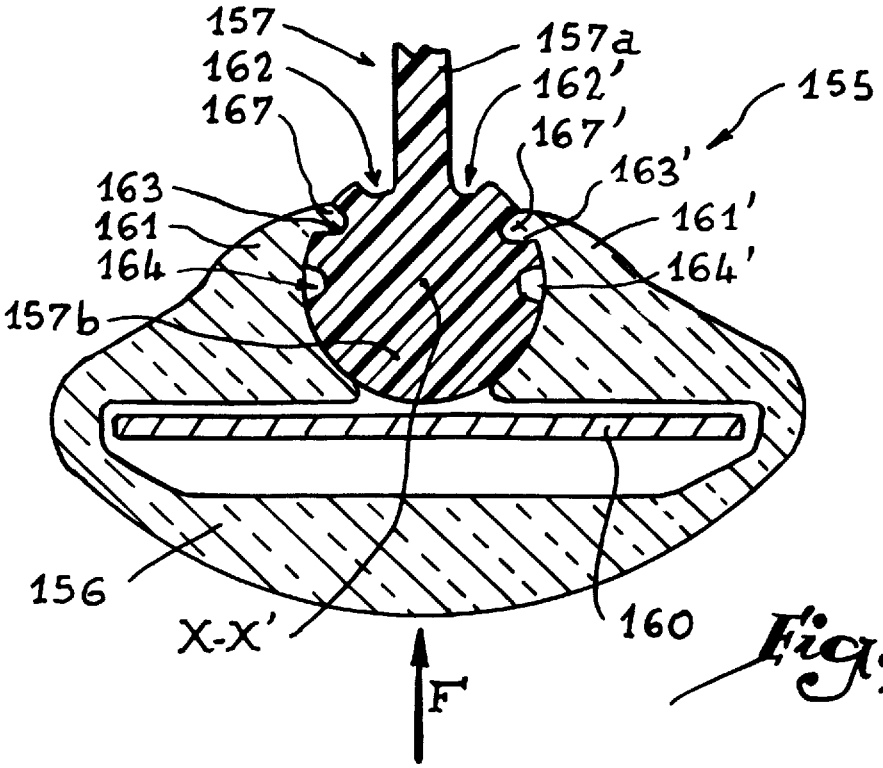
FIG. 14 is a sectional view of an index tab bracket for hanging file folders in accordance with a fifth embodiment of the invention, with the support in such a position that the tab it holds is perpendicular to the large sides of the hanging file folder on which it is mounted.
Figure 15:
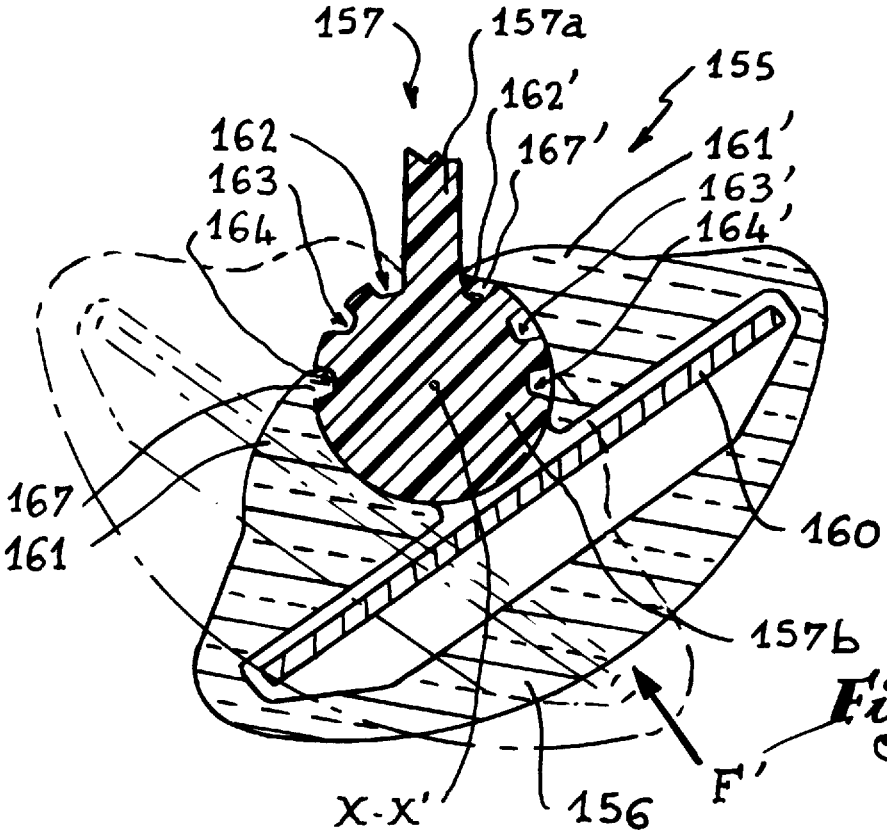
FIG. 15 is a view analogous to that of FIG. 14 with the bracket positioned at an angle with respect to the large sides of the hanging file folder.

FIGS. 14 and 15 show a fourth embodiment of the present invention, in which the elements that are similar to those of the embodiment of FIGS. 1 to 8 are referenced by the same numbers increased by 150. The bracket 155 of this embodiment differs from the previous one essentially in that the stops 167 and 167' provided with extensions 161 and 161' of a transparent sleeve 156 are arranged at the extremities of the extensions 161 and 161', the most distant ones from the tab 160. This extreme position of the stops 167 and 167' allows the maximum benefit from the elastic properties of the plastic material of the extensions 161' and 161' when the sleeve 156 is moved from one position to another. As a matter of fact, the deflection or spring action of the stops 167 and 167', necessary for their withdrawals from the grooves or notches 162 to 164 and 162' to 164' of a cylindrical extension 157*b* of the element 157 in which they are engaged, is facilitated by this position of the stops 167 and 167' at the extremities of the extensions 161 and 161'. As above, the axis of symmetry of the extension 157*b* merges with the pivot axis X–X' of the sleeve 156.

Furthermore, in this embodiment, when the sleeve 156 is positioned at an angle such as shown in FIG. 15, one of the stops 167 or 167' abuts against the body 157*a* of the element 157 and fulfills the function of the extremity 118 or 118' of the foregoing embodiment. This embodiment constitutes thus a simplification with respect to the previous one while the advantages are maintained. As in the previous case, the grooves or notches 162 to 164 and 162' to 164' can either extend or not along the greatest portion of the height of the bracket 155. Also, the stops 167 and 167' can extend along this entire height or over a portion of it or be constituted by several elements aligned in position to simultaneously penetrate into a groove.

In accordance with a not shown embodiment of the present invention, it is possible to design each extension 161 and 161' with several stops, for example, two, that can simultaneously penetrate into two different grooves as in the embodiment of FIGS. 9 and 10.

In the embodiments of the FIGS. 11 to 15, the transparent sleeve can be provided with one only stop on an extension while the extension of the element is provided with one only series of grooves. The second extension has an cylindrical shape on its inside, suitable to interact with a cylindrical shape on the outside of the extension of the element.

Figure 16:
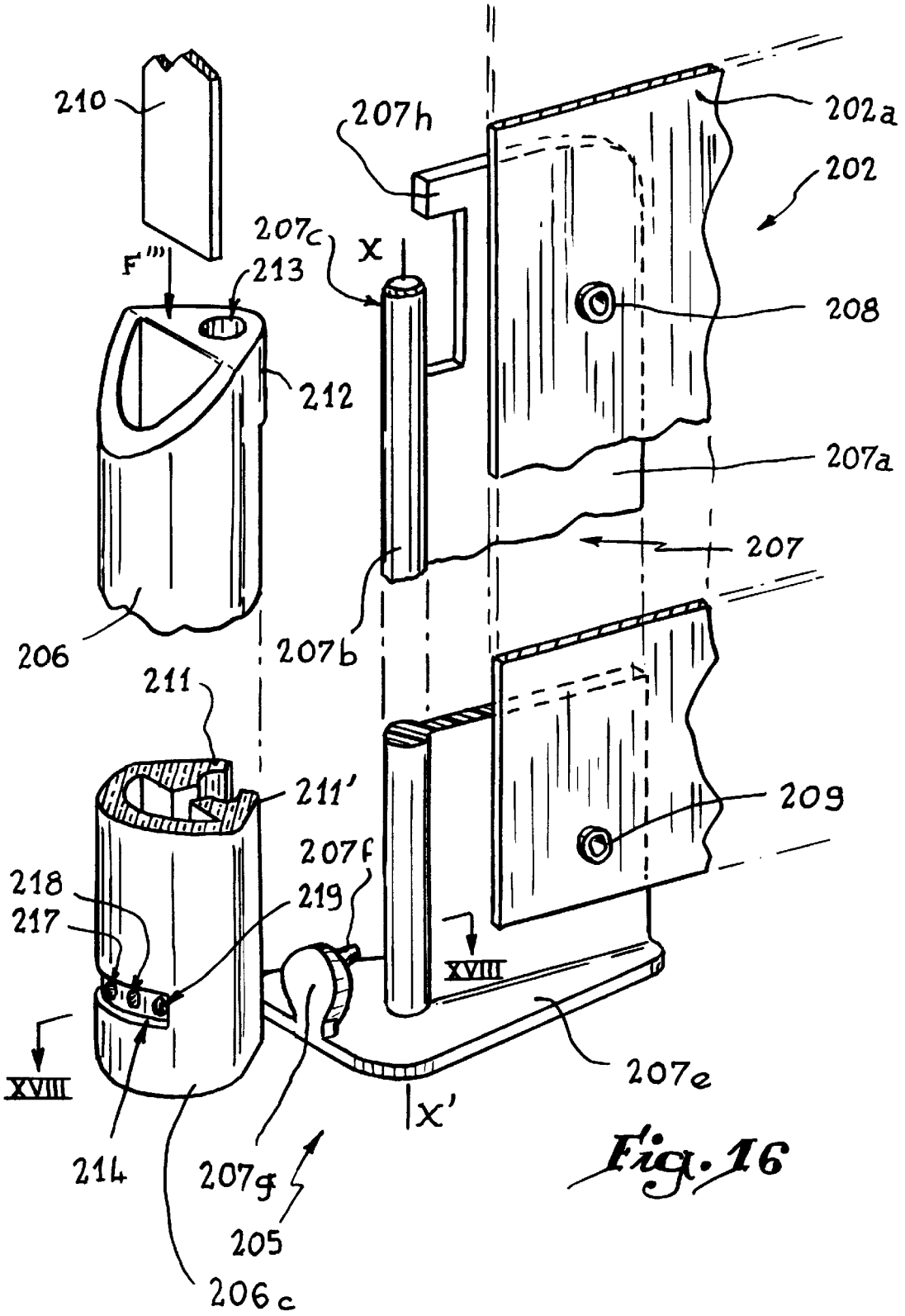
FIG. 16 is an exploded view, in perspective, with a cutaway section of the central portion of an index tab bracket in accordance with a fifth embodiment of the present invention.
Figure 17:
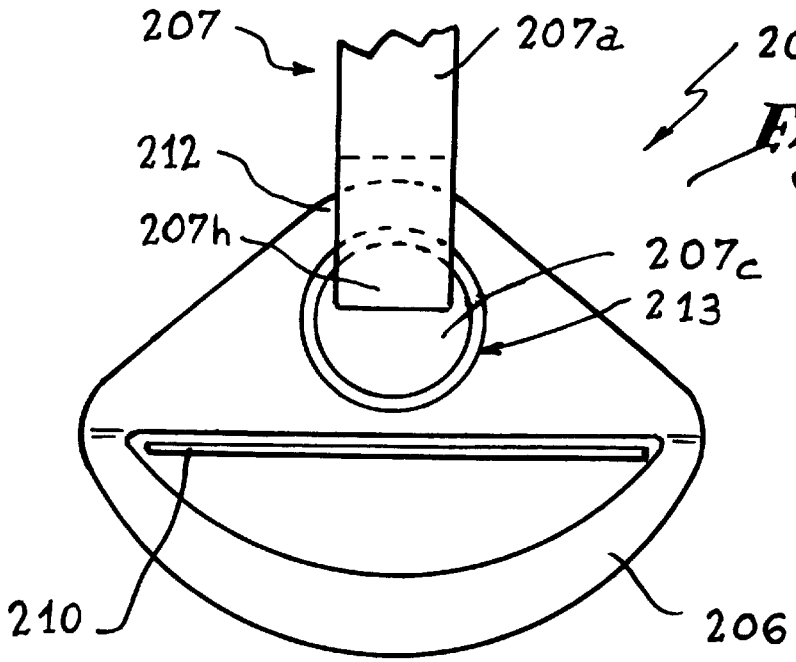
FIG. 17 is a top view of the bracket illustrated in FIG. 16 after the placing of the tab, when the bracket is in such a position that the tab it holds is perpendicular to the large sides of the hanging file folder on which it is mounted.
Figure 18:
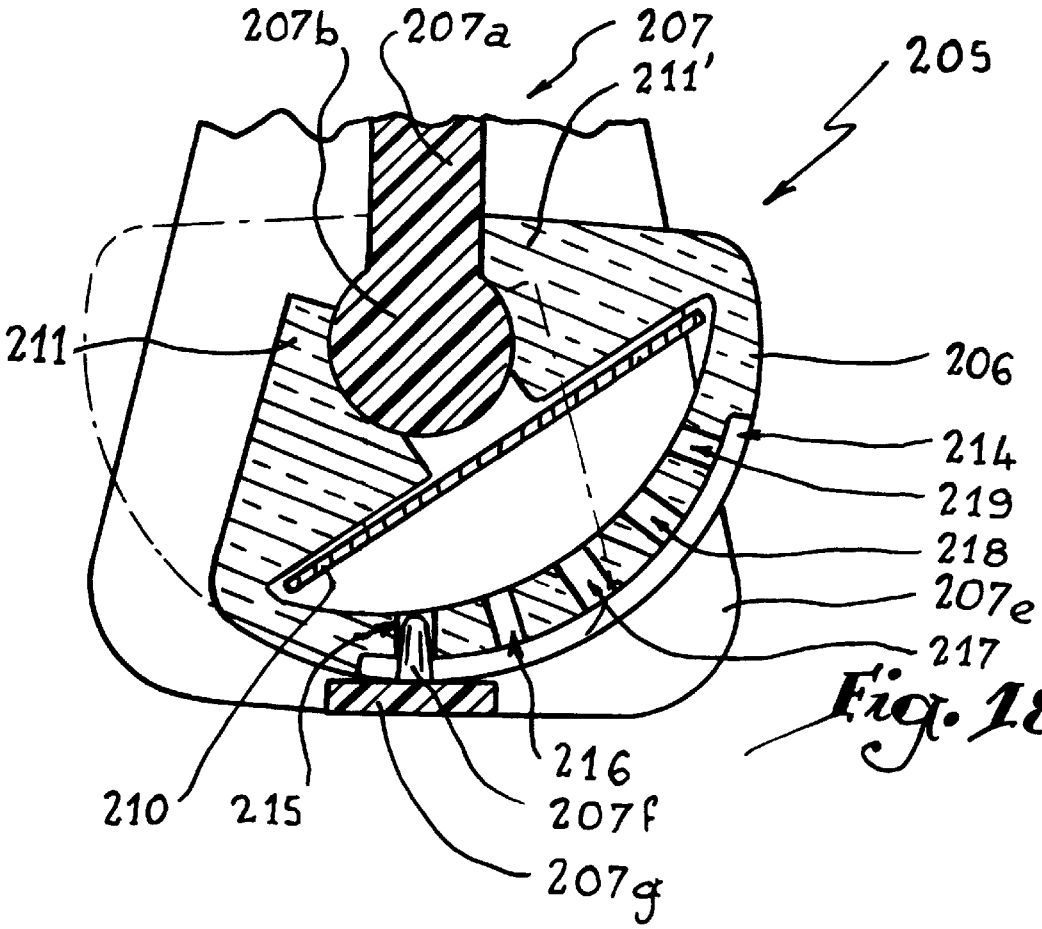
FIG. 18 is a sectional view of the bracket illustrated in FIG. 16 along the line XVII—XVII after the placing of the tab, with the bracket positioned at an angle with respect to the large sides of the hanging file folder.

FIGS. 16 to 18 represent a fifth embodiment of the present invention, in which the elements that are similar to those of the embodiment of FIGS. 1 to 8 are referenced by the same numbers increased by 200. The bracket 205 of this embodiment comprises an element 207 mounted on one side 202*a* of a hanging file folder by means of two rivets 208 and 209. A transparent sleeve 6 is suitable to hold a tab 210 when inserted in a direction F".

The element 207 is essentially constituted by a body 207*a* resting against the side 202*a*, by a cylindrical rod 207*b* that extends more or less parallel to the border of the side 207*a* and of a lug 207*e* that extends perpendicular to the rod 107*b* in the lower portion of the element 207. The cylindrical rod 207*b* is secured to the body 207*a* over the greatest portion of its height. At its top, the rod has an extremity 207*c* disengaged from the body 207*a*.

The transparent sleeve 206 is made out of plastic and is provided with two extensions 211 and 211', suitable to hold tightly the cylindrical rod 207*b*. For this, each of the elements of the extensions 211 and 211' are provided with a circular arc groove whose radius is more or less equal to that of the rod 107*b*. The sleeve 206 is provided on its upper portion with an extension 212 having a cylindrical hole 213. The element 207 is provided on its upper portion with a pin 207*h* that extends from the body 207*a* in direction of the extremity 207*c* of the rod 207*b*.

The functioning is as follows. When it is necessary to place the sleeve 106 over the element 107, it is driven by a vertical translatory motion downwards along the axis X–X' of the rod 207*b* until its lower extremity 206*c* abuts against the lug 207*e*. The extension 212 is inserted between the pin 207*h* and the extremity 207*c*. The hole 213 receives then the extremity 207*c* of the rod 207*b*. Taking into account the design of the extremities 211 and 211' and of the rod 207*b*, the sleeve 206 can turnabout the axis X–X' in order to attain the directional position desired by the user, while the pin 207*h* does not allow an upward drawing of the sleeve 206 in FIG. 16.

Furthermore, the lug 207*e* is provided on an extension 207*g* with a stop 207*f* in the direction towards the rod 207*b*, that is to say, towards the sleeve 206 when it is in place on the bracket. The sleeve 206 is provided on its external side, in the proximity of its lower extremity 206*c*, with a groove 214 into which receives the stop 207*f* when the sleeve is in place. The stop 207*f* prevents an eventual translatory motion towards the upper part of the sleeve 206 when it is in place.

As an alternative, it is possible to arrange that the retention of the sleeve 206 be effectuated only by the pin 207*h* or by the stop 207*g*.

Five notches 215 to 219 are provided in a circular arc at the bottom of the groove 214 so that the stop 207*f* can penetrate into one of them depending on the position of the sleeve 206 about the axis X–X' and immobilize the sleeve in that position. The notches 215 to 219 may or may not lead into the inside of the sleeve 206 where the tab is located.

As in the embodiments of the FIGS. 11 to 15, the extremity of the extensions 211 and 211' abut against the body 207*a* when the sleeve is in its most oblique position with respect to the body.

The brackets shown in the accompanying drawings are provided with three, four, five or six notches but the present invention is applicable to any number of notches. This number and the position of the notches are determined in accordance with the direction or the directions sought for the sleeve. In particular, several slanted positions having angles of 20°, 35°and 50° can be obtained by logical selection, depending on the reach of the user, of the number and the position of the notches and/or of the stops.

I claim:

1. A bracket for supporting an index tab relative to a file folder comprising;

a sleeve means adapted to retain the index tab, and means for pivotally securing said sleeve means to the file folder so as to be adjustable about a vertical axis relative to the file folder whereby the index tab may be selectively oriented relative to the file folder when in use.

2. The bracket of claims 1 wherein said sleeve means is transparent and an opening in said sleeve means into which the index tab may be selectively received.

3. The bracket of claim 1 including means for retaining said sleeve means in a selected orientation relative to the file folder.

4. The bracket of claim 3 in which said means for retaining includes a plurality of notches formed in said sleeve means and said means for pivotally securing said sleeve means to the file folder including an element adapted to be mounted to the file folder, and said means for retaining including at least one stop member extending outwardly from said element and of a size to be selectively received in one of said plurality of notches in said sleeve means.

5. The bracket of claim 4 in which said plurality of notches are formed in an extension extending outwardly from one end of said sleeve means toward said at least one stop member.

6. The bracket of claim 5 including a plurality of notches in an opposite end of said sleeve means, and said element including a second stop member which is selectively engageable with one of said plurality of notches in said opposite end of said sleeve means.

7. The bracket of claim 6 in which said element includes a first portion adapted to be connected to the file folder and a flange connected to said first portion by an integrally formed hinge portion, and said sleeve means including opposing extremities spaced intermediate said one and said opposite ends thereof for selectively engaging opposite edges of said flange whereby said flange is pivotable about said integral hinge.

8. The bracket of claim 7 in which said flange extends between said first and second stop members.

9. The bracket of claim 8 in which each of said opposing extremities includes a recessed groove.

10. The bracket of claim 5 in which said element includes a first portion adapted to be secured to the file folder and a flange connected to said first portion by an integral hinge and extending generally perpendicularly with respect to said first portion, said sleeve means including opposing extremities for engaging opposite edges of said flange.

11. The bracket of claim 10 including a pair of spaced stop members extending from said first portion of said element and being selectively receivable in spaced notches of said plurality of notches in said extension portion of said sleeve means.

12. The bracket of claim 10 in which each of said opposing extremities of said sleeve means includes a groove therein.

13. The bracket of claim 10 in which said plurality of notches are oriented along an arc of a circle with respect to one another.

14. The bracket of claim 3 wherein said means for pivotally securing said sleeve means to the file folder includes an element having a first portion adapted to be secured to the file folder and a generally cylindrical portion extending from said first portion, said cylindrical portion including a plurality of grooves therein, and said sleeve means including a pair of generally opposing extensions, said means for retaining said sleeve means in a selective orientation including a stop member carried by at least one of said extensions and being of a size to cooperatively engage in one of said grooves of said cylindrical portion of said element.

15. The bracket of claim 14 in which each of said extensions includes a stop element.

16. The bracket of claim 3 in which said means for pivotally securing said sleeve means to the file folder includes an element having a first portion adapted to be mounted to a file folder and a generally cylindrical portion connected to said first portion, said sleeve means including opposing extremities having a configuration to cooperatively receive said cylindrical proportion of said element therebetween such that said sleeve means is pivotable about said cylindrical portion of said element.

17. The bracket of claim 16 in which said means for retaining said sleeve means includes a plurality of openings in said sleeve means, and a stop member extending from said element and being selectively engageable in one of said openings in said sleeve means.

18. The bracket of claim 17 in which said sleeve means includes an extension adjacent one end thereof, an opening in said extension of a size to selectively receive one end of said cylindrical portion of said element.

19. A combination file folder and bracket for supporting an index tab to the file folder comprising a file folder, a bracket including a sleeve means adapted to retain the index tab, and means for pivotally securing said sleeve means to said file folder so as to be adjustable about a vertical axis relative to said file folder whereby the index tab may be selectively oriented relative to said file folder when said file folder is in use.

20. The combination of claim 19 in which said means for pivotally securing said sleeve means to said file folder includes a support element having a first portion secured to said file folder and a second portion for engaging said sleeve means, and stop means extending between said sleeve means and said second portion of said support element for securing said sleeve means in a selected oriented relationship with respect to said second portion of said support element.

* * * * *